US006116182A

United States Patent [19]

Koyanagi

[11] Patent Number: 6,116,182

[45] Date of Patent: Sep. 12, 2000

[54] HULL FOR PERSONAL WATERCRAFT

[75] Inventor: Tomoyoshi Koyanagi, Shizuoka, Japan

[73] Assignee: Yamaha Hatsudoki Kabushiki Kaisha, Shizuoka, Japan

[21] Appl. No.: 09/291,388

[22] Filed: Apr. 13, 1999

[30] Foreign Application Priority Data

Apr. 13, 1998 [JP] Japan ..... 10-101133

[51] Int. Cl.[7] ..... B63B 17/00

[52] U.S. Cl. ..... 114/362; 114/55.57

[58] Field of Search ..... 114/55.5, 55.7, 114/362; 440/38

[56] References Cited

U.S. PATENT DOCUMENTS

| | | | |
|---|---|---|---|
| 4,738,642 | 4/1988 | Koyama et al. | 114/362 |
| 4,945,852 | 8/1990 | Kobayashi . | |
| 4,979,459 | 12/1990 | Tani et al. . | |
| 4,982,682 | 1/1991 | Hattori . | |
| 5,123,372 | 6/1992 | Kobayashi et al. . | |
| 5,131,346 | 7/1992 | Ohta et al. . | |
| 5,152,244 | 10/1992 | Jarmillo et al. | 114/362 |
| 5,255,625 | 10/1993 | Hattori . | |
| 5,320,059 | 6/1994 | Ikeda . | |
| 5,372,083 | 12/1994 | Hattori . | |
| 5,401,197 | 3/1995 | Kobayashi . | |
| 5,406,904 | 4/1995 | Kobayashi . | |
| 5,447,116 | 9/1995 | Kobayashi . | |
| 5,537,948 | 7/1996 | Kobayashi . | |
| 5,584,733 | 12/1996 | Kobayashi . | |
| 5,588,887 | 12/1996 | Ikeda . | |
| 5,676,086 | 10/1997 | Watkins . | |
| 5,915,329 | 6/1999 | Watkins et al. | 114/362 |
| 5,943,979 | 8/1999 | Hattori | 114/362 |

*Primary Examiner*—Stephen Avila
*Attorney, Agent, or Firm*—Knobbe, Martens, Olson & Bear LLP

[57] ABSTRACT

A watercraft includes a hull construction that incorporates raised aft foot area sections to increase the buoyancy of the watercraft. The watercraft also includes an elongated seat that can be straddled by at least two riders. An aft portion of the seat that extends between the raised aft foot area sections has a narrowed width in comparison to a portion of the seat extending over an engine of the watercraft to improve the comfort of the rider sitting on the aft seat portion. The wider seat portion over the engine accommodates a wider engine to eliminate sharp bends in exhaust and induction pathways and thereby improve engine performance. The watercraft hull also includes an integral boarding aid formed at the aft end of the seat and extending contiguous with a deck platform. The boarding aid includes first and second members that extend toward a stern of the watercraft and are arranged to be grasped by a person, when in the body of water in which the watercraft is operated, with his or her arms spread apart by about shoulder's width. This arrangement aids the person to push down on the aft end of the watercraft and to pull himself or herself onto the deck platform.

36 Claims, 7 Drawing Sheets

HULL FOR PERSONAL WATERCRAFT

BACKGROUND OF THE INVENTION

1. Field of the Invention

The present invention relates to a small watercraft, and more particularly to a hull design for a small watercraft.

2. Description of Related Art

Personal watercraft have become very popular in recent years. This type of watercraft is quite sporting in nature and carries a rider and possibly one, two, three or four passengers. A relatively small hull of the personal watercraft commonly defines a riders' area above an engine compartment. An internal combustion engine frequently powers a jet propulsion unit which propels the watercraft. The engine lies within the engine compartment in front of a tunnel formed on the underside of the watercraft hull. The jet propulsion unit is located within the tunnel and is driven by the engine.

Power demands on personal watercraft engines have increased in recent years with the increased number of passengers and loads the watercraft are designed to carry, with a desire for faster top-end speeds, and with towing requirements. Larger size engines thus typically power personal watercraft these days to meet these demands. For instance, most watercraft manufacturers now provide three-cylinder engines with their larger watercraft models (i.e., three- and four-seaters). Larger engines though are heavier.

The increased weight of the engine, and thus the watercraft, causes the watercraft to float at a lower position in the water. This lower position (i.e. greater hull displacement) increases the time required to accelerate the watercraft from rest to planing speeds. While the larger engine improves the watercraft's performance some of the performance gains are lost because the watercraft hull starts from a deeper position and cannot pop-up on plane as quickly.

Larger engines also pose design problem because personal watercraft usually have relatively small engine compartments. In order to handle increased intake air and exhaust gas volumes, the associated induction and exhaust systems of the engine desirably increase in size, which exacerbates the problems associated with the compact size of the engine compartment. The induction and exhaust systems consequently are forced to assume sharply curved flow paths (i.e., flow paths including bends having small radii of curvature). Such tight bends in the flow path of intake and exhaust gases reduces engine performance. For instance, such tight bends in the exhaust system increase the back pressure in the exhaust system, which interferes with the proper exhaustion of the burnt charges from the combustion chambers of the engine cylinders.

A need therefore exists for an improved hull design that improves the buoyancy of the watercraft and provides increased room within the hull to accommodate larger engines.

SUMMARY OF THE INVENTION

An aspect of the present invention thus involves a watercraft comprising a body having a lower hull and an upper deck. The lower hull includes a keel line. The upper deck includes a pair of raised gunnels that extend along at least a portion of a length of the watercraft body, and a longitudinally extending seat that includes at least a front rider position and an aft rider position arranged rearward of the front rider position on the seat. The seat is positioned between the raised gunnels. Foot areas are arranged between the raised gunnels and the seat, and a deck platform is positioned behind the foot areas. Each foot area is formed in part by a floor that extends to the deck platform. The floor has a raised aft section that rises above the level of the deck platform relative to the keel line. These raised aft floor sections accommodate additional flotation elements near the aft end of the watercraft to lessen hull displacement at the aft end of the watercraft. As a result, the watercraft can rise up on plane more quickly.

In one mode, each of the raised aft floor sections has a generally curvilinear shape, and extends in a longitudinal direction, which is generally parallel to the keel line, from a point forward of an aft end of the seat aft rider position to a point rearward of the aft end of the seat aft rider position. The foot area floors and deck platform of the deck also can have a unitary construction.

The watercraft preferably includes a seat having a pedestal with a sufficient width to accommodate induction and exhaust systems of the engine without requiring bends within the induction and exhaust systems that impede flow through these system to a degree that meaningfully impacts engine performance.

The wider seat pedestal coupled with the raised aft sections of the foot area floors, however, may effect the comfort and the feeling of security of some riders who are seated at the aft rider position on the watercraft seat. For this reason, in one mode, the seat pedestal narrows in width at its aft end to permit the aft-seated rider to position their legs closer together.

In accordance with another aspect of the present invention, a watercraft is provided having a body comprised of a lower hull and an upper deck. The upper deck includes a longitudinally extending seat that is positioned between a pair of raised gunnels. A deck platform is arranged behind the seat. First and second members extend toward a stern of the watercraft and are arranged contiguous to the deck platform. Each of the first and second members has a length so dimensioned to be grasped by a hand of a rider when entering the watercraft from a body of water in which the watercraft is operated. The first and second members thus function as a boarding aid that can be grasped by the hands of the rider (which are spread apart at shoulder width in one mode) to push down on the aft end of the watercraft and to pull himself or herself onto the deck platform.

Further aspects, features, and advantages of the present invention will become apparent from the detailed description of the preferred embodiment which follows.

BRIEF DESCRIPTION OF THE DRAWINGS

The above-mentioned and other features of the invention will now be described with reference to the drawings of a preferred embodiment of the present watercraft. The illustrated embodiment of the watercraft is intended to illustrate, but not to limit, the invention. The drawings contain the following figures.

DETAILED DESCRIPTION OF THE PREFERRED EMBODIMENT

FIGS. 1 through 7 illustrate a personal watercraft 10 that includes a hull design configured in accordance with a preferred embodiment of the present invention. Although the hull features are illustrated in connection with a personal watercraft, the hull features can be used with other types of watercraft as well, such as, for example, but without limitation, small jet boats and the like.

The following describes the illustrated watercraft in reference to a coordinate system in order to ease the description of the watercraft 10. A longitudinal axis extends from bow to stern and a lateral axis extends from port side to starboard side normal to the longitudinal axis. A vertical axis extends normal to both the longitudinal axis and the lateral axis. In addition, relative heights are expressed in reference to an undersurface of the watercraft hull. And in FIG. 1, a label "Fr" has been included and designates a forward direction for reference purposes.

Figure 1:
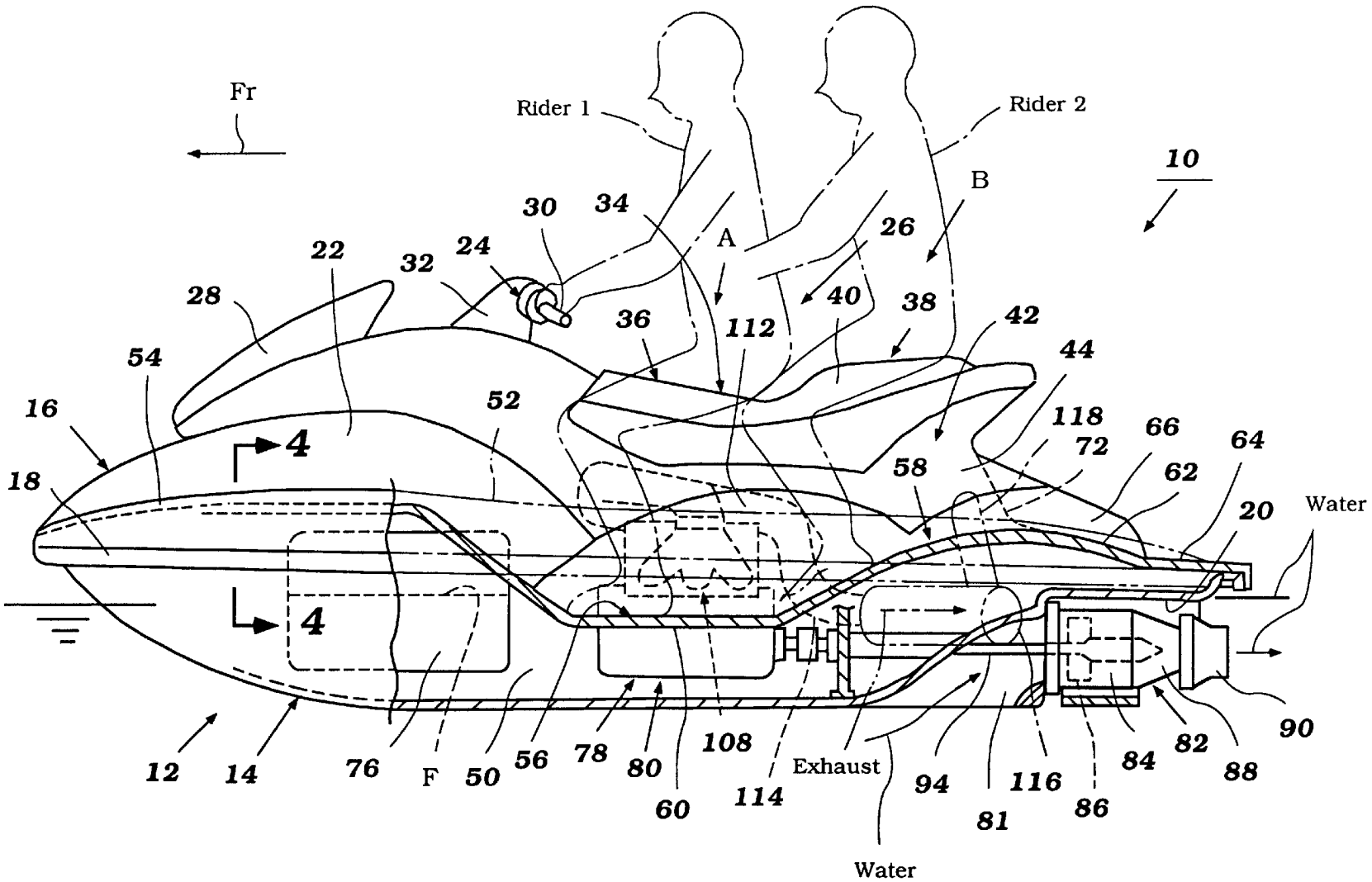
FIG. 1 is a partial cross-sectional, side elevational view of a personal watercraft configured in accordance with a preferred embodiment of the present invention.
Figure 2:
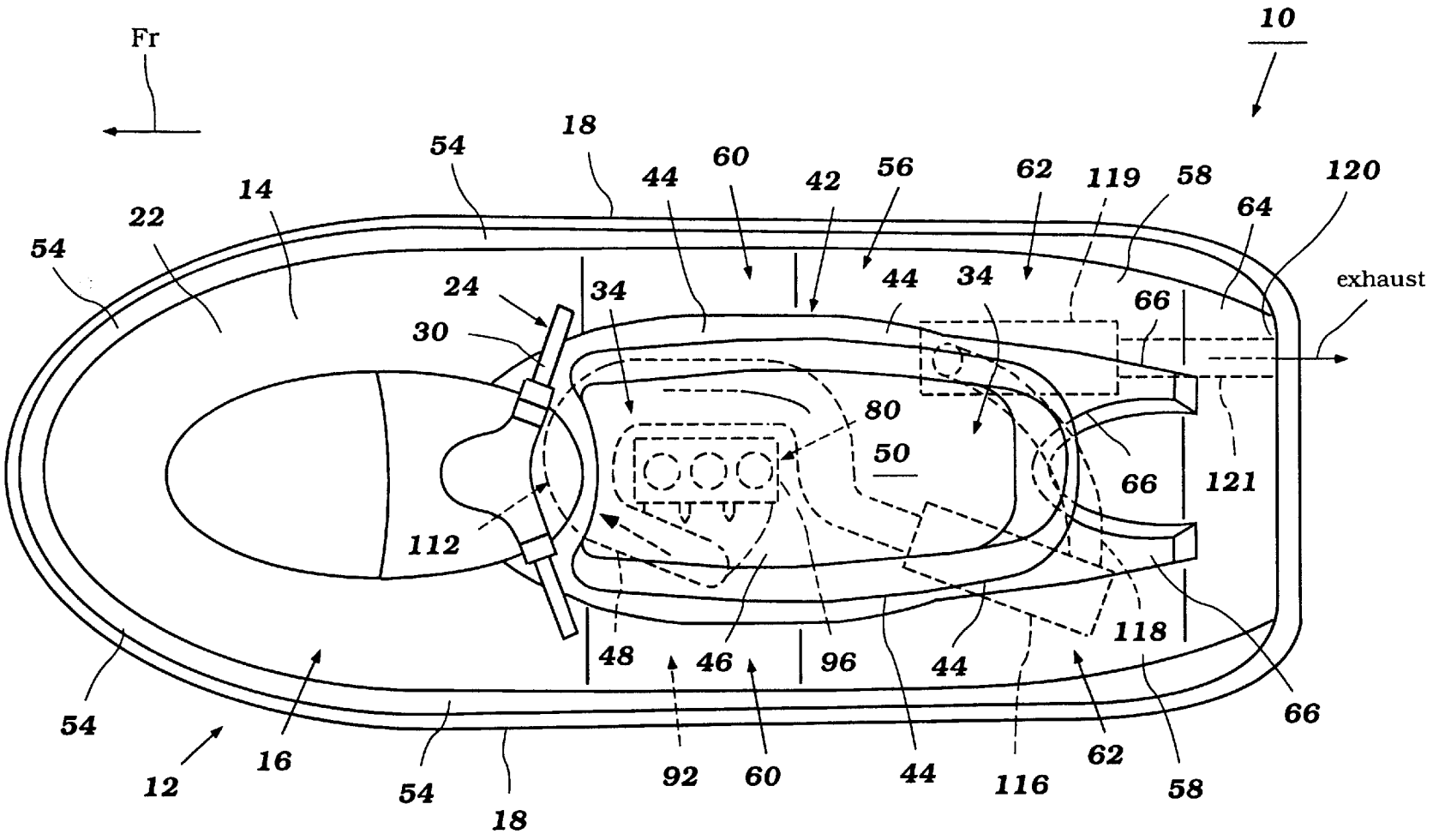
FIG. 2 is a top plan view of the preferred embodiment of the personal watercraft.

With initial reference to FIGS. 1 and 2, the watercraft 10 includes a hull body 12 formed by a lower hull 14 and a deck 16. The lower hull 14 and the deck 16 are formed from a suitable material such as, for example, a molded fiberglass reinforced resin or SMC. The lower hull 14 and the deck 16 are fixed to each other around the peripheral edges in any suitable manner.

In the illustrated embodiment, a bond flange 18 is defined as the overlapping mating section where the lower hull 14 and the deck 16 are joined together. The bond flange 18 also identifies the location of a bond line, which is an imaginary line around the watercraft 10 where the hull 14 and the deck 16 are joined together. Accordingly, the deck 16 generally comprises the upper structural body of the watercraft 10, which includes the upper bond flange 18.

The lower hull 14 is designed such that the watercraft 10 planes or rides on a minimum surface area at the aft end of the lower hull 14 in order to optimize the speed and handling of the watercraft 10 when up on plane. For this purpose, the lower hull 14 generally has a V-shaped configuration formed by a pair of inclined sections that extend outwardly from a keel line of the hull to the hull's side walls at a dead rise angle. The inclined sections also extend longitudinally from the bow toward the transom of the lower hull 14. The side walls are generally flat and straight near the stern of the lower hull and smoothly blend towards the longitudinal center of the watercraft at the bow. The lines of intersection between the inclined section and the corresponding side wall form the outer chines of the lower hull 14.

Toward the transom of the watercraft, the inclined sections of the lower hull 14 extend outwardly from a recessed channel or tunnel 20 that extends upward toward the deck 16. The tunnel 20 has a generally parallelepiped shape and opens through the rear of the transom of the watercraft 10, as best understood from FIGS. 6 and 7.

With reference to FIG. 1, the deck 16 includes a bow portion 22, a control mast 24 and a rider's area 26, as viewed in the direction from the bow to the stern of the watercraft 10. The bow portion 22 slopes upwardly toward the control mast 24 and includes at least one air duct (not shown) through which air can enter and/or exit the hull 14. A hatch cover 28 desirably extends above an upper port of the air duct to inhibit an influx of water into the hull 14.

The control mast 24 extends from the bow portion 22 and supports a handlebar assembly 30. The handlebar assembly 30 controls the steering of the watercraft 10 in a conventional manner. The handlebar assembly 30 also carries a variety of controls of the watercraft 10, such as, for example, a throttle control, a start switch and a lanyard switch. In the illustrated embodiment, a cowling 32, which covers the deck 16, forms a portion of the control mast 24. The deck 16 supports a steering column to which the handlebar assembly 30 is attached, at a point beneath the cowling 32.

A display panel (not shown) desirably is located in front of the control mast 24 on the bow portion 22 and is orientated to be visible by the front rider (e.g., Rider 1). The display panel desirably displays a number of performance characteristics of the watercraft, such as, for example, watercraft speed (via a speedometer), engine speed (via a tachometer), fuel level, oil level, engine temperature, battery charge level and the like.

The rider's area 26 lies behind the control mast 24 and includes a seat assembly 34. In the illustrated embodiment, the seat assembly 34 has a longitudinally extending straddle-type shape that may be straddled by an operator and by at least one, two or three passengers.

As best illustrated in FIG. 1, the seat assembly 34 includes a front seat section 36 and a rear seat section 38 with the front seat section 36 corresponding to a front rider position A on the seat and the second seat section 38 corresponding to an aft rider position B on the seat 34. While the seat assembly 34 is illustrated as sized to accommodate only two passengers, the seat assembly 34 can include additional rider positions arranged between the front and aft rider positions A, B.

In the illustrated embodiment, the seat sections 36, 38 are unitarily formed together along a contoured seat pad 40. As seen in FIG. 1, the contoured seat pad is configured to elevate the aft seat section 38 relative to the front seat section 36. The seat pad 40 includes a cushion covered by a water-resilient material and is supported by a seat base. The seat base desirably is formed of a light-weight material.

The seat pad 40 is releasably attached to a pedestal 42 on the deck 16 and covers the access opening 48. A seal 49 is positioned between the pedestal upper surface 46 and the base of the seat pad 40 to inhibit an influx of water into the hull 14 through the access opening 48.

The pedestal 42 includes a pair of side walls 44 and an upper surface 46. The upper surface 46 defines an access opening 48 that opens into an engine compartment 50 defined between the lower hull 14 and the deck 16. Although not illustrated, a rear air duct may communicate with a hole formed on the upper surface 46 of the pedestal 42 at a position where air can flow between the pedestal 42 and the seat pad 40.

Figure 4:
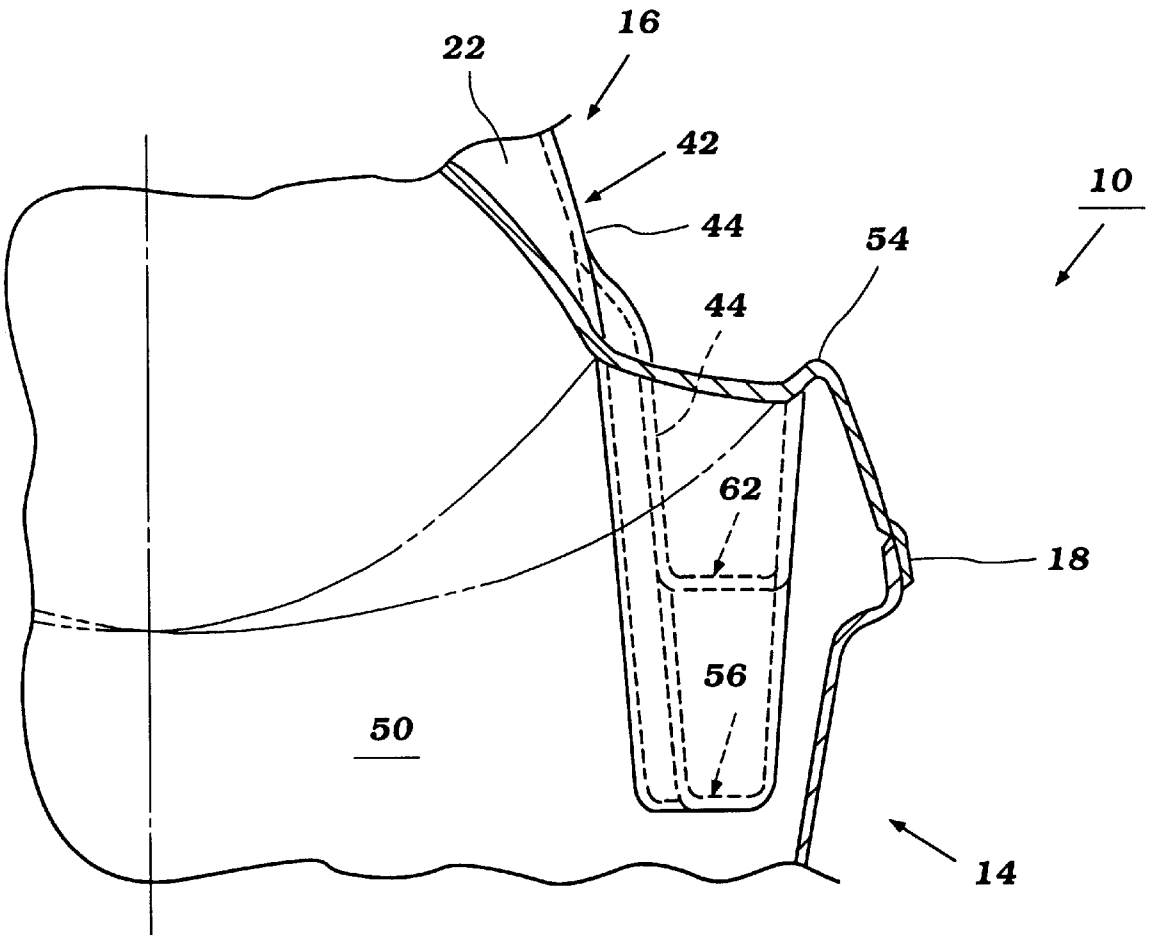
FIG. 4 is a cross-sectional view of the personal watercraft of FIG. 1 taken along line 4—4.

As best seen in FIGS. 2 and 4, the side walls 44 of the pedestal 42 are spaced apart by a lateral width. The lateral width is greater at a location generally corresponding to the front rider position A than at a location generally corresponding to the aft rider position B. In the illustrated embodiment, the lateral spacing between the pedestal side walls 44 gradually increases in the forward direction at a point generally corresponding to the aft rider position B and then converges toward each other starting at a point generally corresponding to the front rider position A. The width of the front end of the pedestal 42 at a point near the control mast 24 generally matches the width of the aft end of the pedestal 42, as best seen in FIG. 2. The seat pad has a similar shape as depicted in FIG. 2. This seat configuration accommodates a larger engine without sacrificing the comfort of the front and aft riders. The aft end of the seat pedestal also is configured to provide a hand grip for the person seated in the aft rider position B.

The deck 16 of the hull body 12 includes a pair of raised gunnels 52 positioned on opposite sides of the aft end of the deck 16. The gunnels 52 extend along side the passenger area 26 and merge into the bow 22 at the front end of the gunnels 52. A generally longitudinally extending ridge 54 is formed on the bow 22 of the deck 16 to extend the visual line of the gunnels 52 along the length of the watercraft 10. The ridge 54 desirably includes a dual wall construction, as represented in FIG. 1, to strengthen the watercraft bow 22 at this location.

The raised gunnels 52 define a pair of foot areas or wells 56 that extend generally longitudinally and parallel to the sides of the pedestal 42. In this position, the operator and any passengers sitting on the seat assembly can place their feet in the foot areas 56 with the raised gunnels 52 shielding the feet and lower legs of the riders. A non-slip (e.g., rubber) mat desirably covers the foot areas 56 to provide increased grip and traction for the operator and the passengers.

The foot areas 56 include a floor 58 that includes a lower fore section 60 and a raised aft section 62. In the illustrated embodiment, the lower fore section 60 has a generally flat shape that lies substantially parallel to the keel line of the lower hull 14. The raised aft section 62 extends from the fore section 60 and follows a generally curvilinear path. The raised aft section 62 preferably has an arcuate shape so as to define a smooth hump at the aft end of the foot area 56. As appreciated from FIGS. 1 and 5, the raised aft sections 62 of the foot areas (as well as the fore section of a deck platform, which is described below) increases the space inside the hull 14. These spaces are filled with flotation elements to increase the buoyancy of the aft end of the watercraft and buoy the planing surface of the watercraft 10 so as to lie closer to the water surface level despite the watercraft including a heavier engine.

A deck platform 64 is formed at the aft end of the deck 16. As best seen in FIG. 1, each raised aft section 62 rises to a level above the deck platform 64. Not only does this arrangement accommodate enlarged flotation elements at the aft end of the watercraft 10, but it also inhibits an influx of water into the foot wells 56 when the watercraft is at rest or traveling at slow speeds (i.e., non-planing speeds).

The deck 16 also preferably includes an integral boarding aid to assist a person to enter the watercraft 10 from the stern side when the person is floating in the body of water in which the watercraft 10 is operated. The boarding aid desirably is used with the illustrated hull design because of the increased buoyancy of the aft end of the hull 12. The boarding aid, however, can be used with hull designs that do not include either the raised aft foot area floors or the seat configuration described above.

The boarding aid includes first and second members 66 that extend toward the stern of the watercraft 10. Each member 66 includes an upper edge 68 (FIG. 7) that can be grasped by the person attempting to board the watercraft 10. The upper edges 68 extend above the deck platform 64, but each member 66 lies contiguous with the deck platform 64 and is positioned generally between the raised gunnels 52.

In the illustrated embodiment, the members 66 of the boarding aid are integrally formed with the seat pedestal 42 and project rearward and slightly outward from a rear wall 70 of the seat pedestal 42. The aft ends of the members 66 are spaced apart from each other by a distance generally matching the shoulder width of an average adult person. In one form, this spacing is generally between 1.5 feet and 2 feet; however, other spacings are also possible. It is preferred though that the spacing be generally less than a width of the seat assembly 34.

Figure 5:
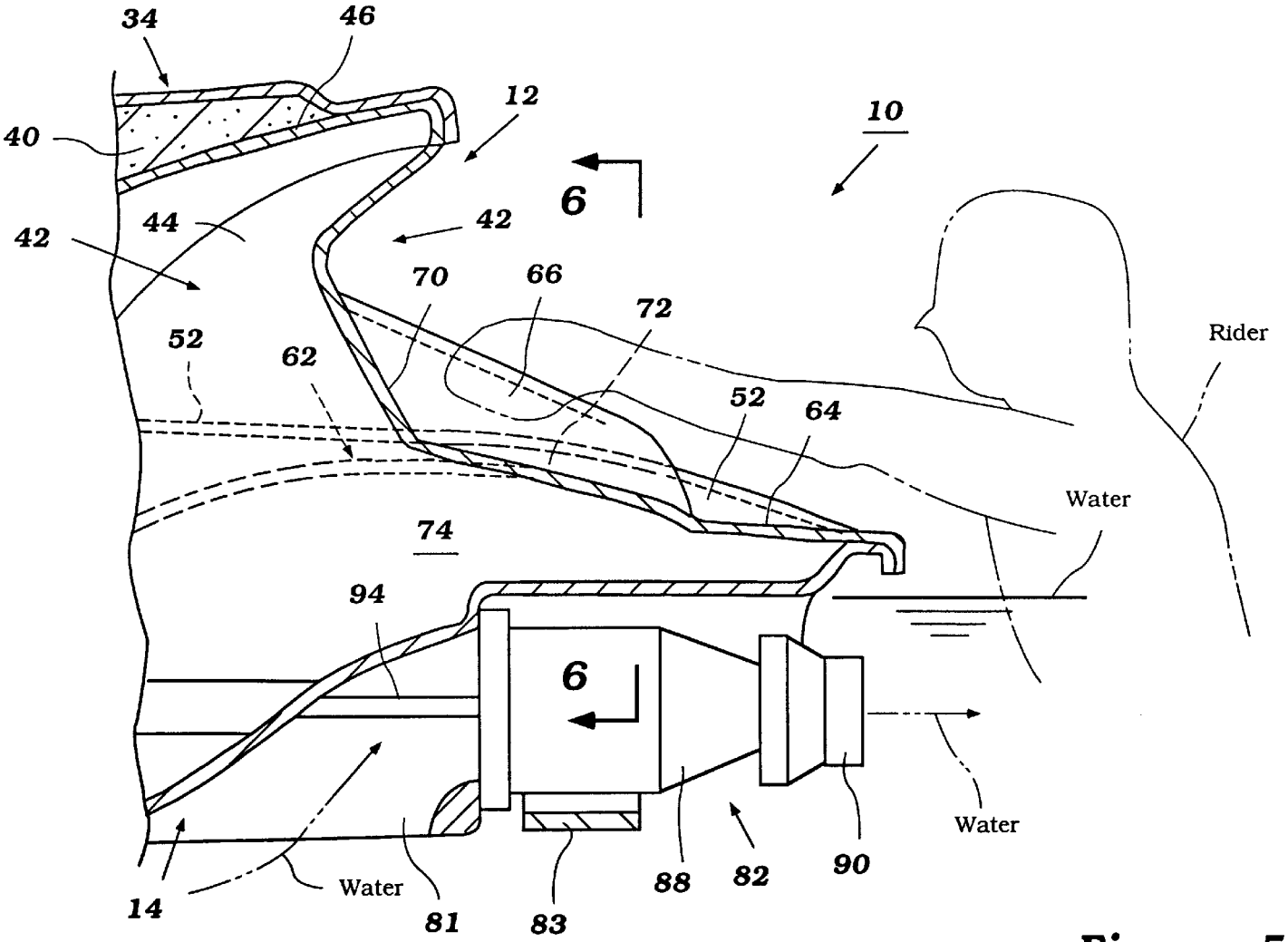
FIG. 5 is an enlarged cross-sectional view of an aft end of the personal watercraft of FIG. 1.
Figure 6:
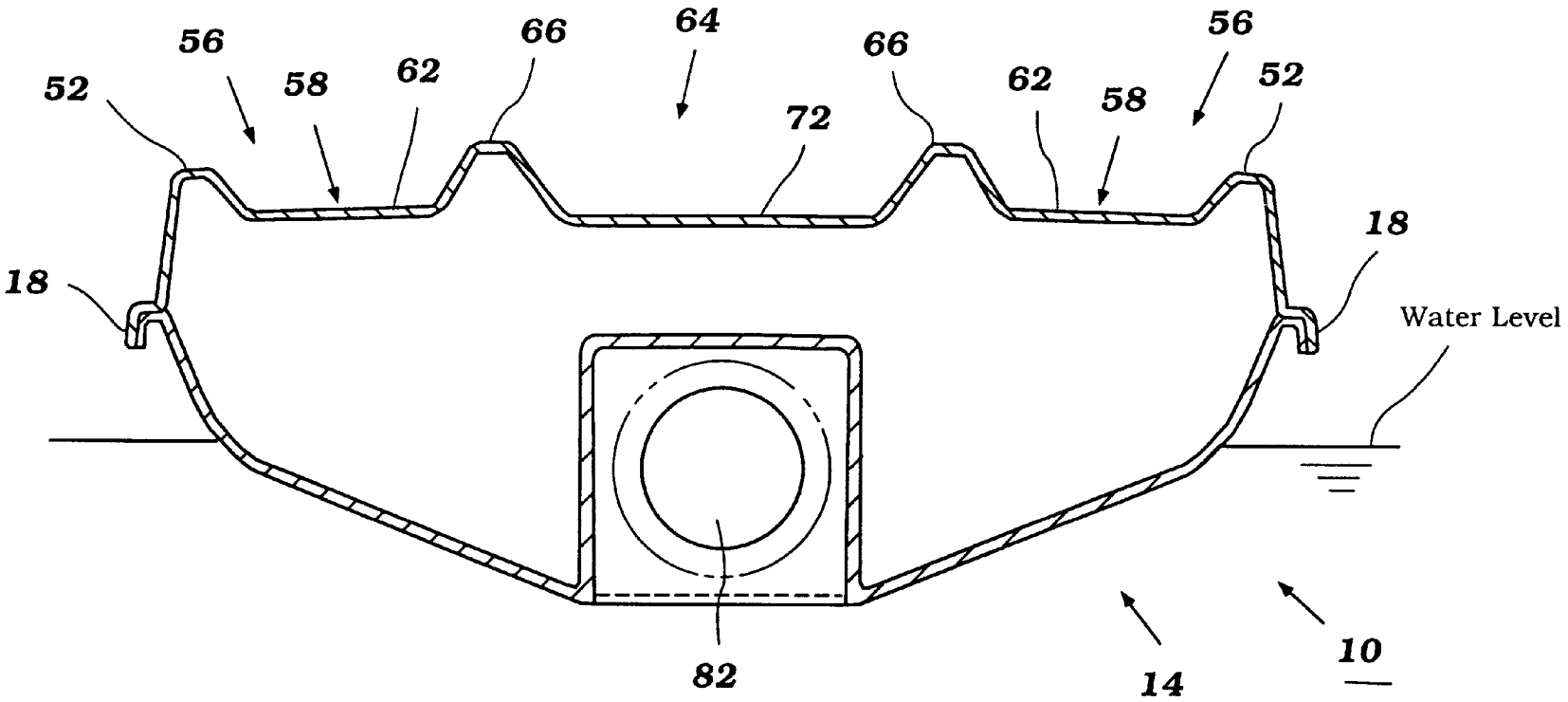
FIG. 6 is a cross-sectional view of the personal watercraft of FIG. 5 taken along line 6—6.
Figure 7:
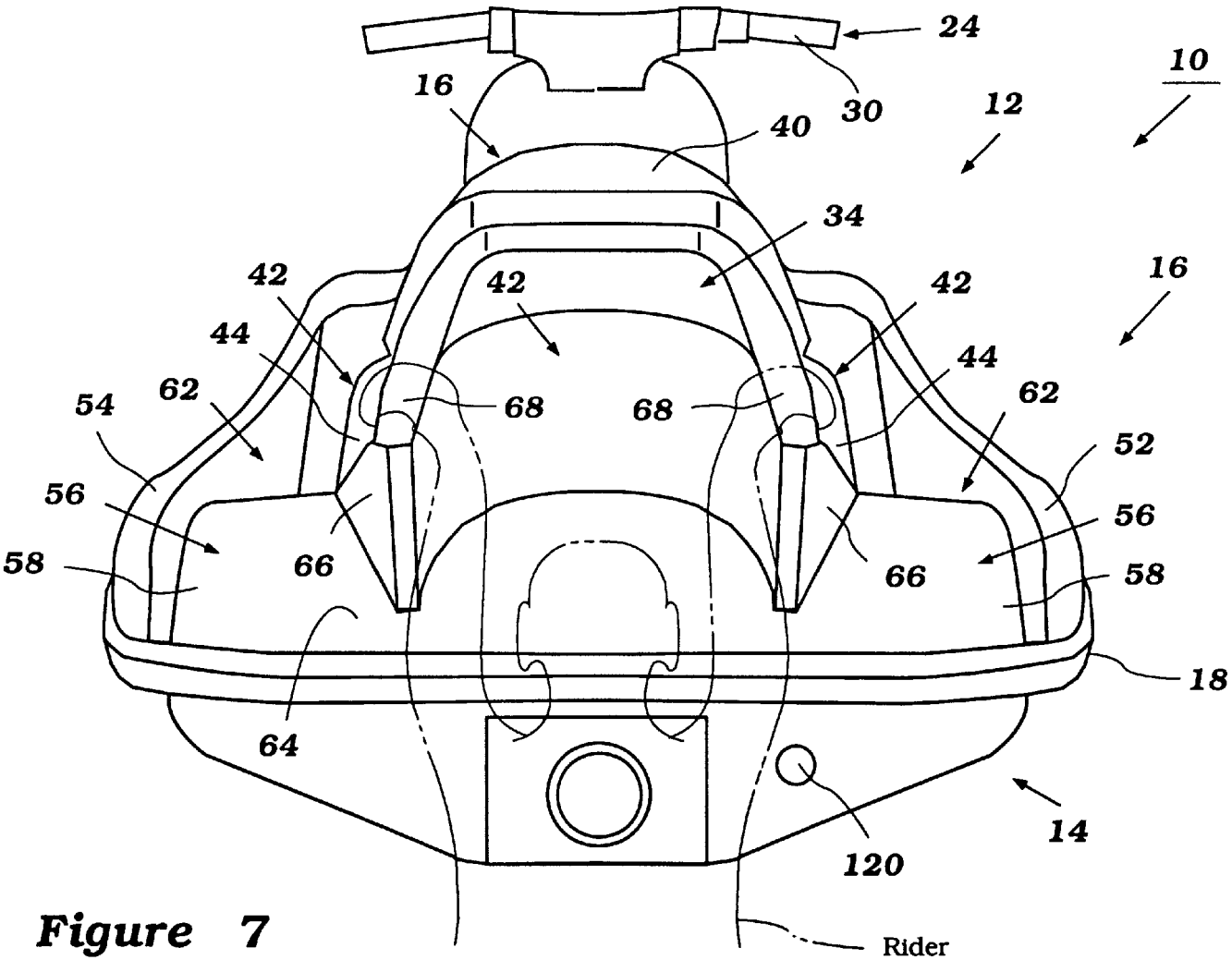
FIG. 7 is a rear elevational view of the preferred embodiment of personal watercraft.

As understood from FIGS. 5–7, the deck platform 64 includes a forward section 72 that extends between the members 66 of the boarding aid. The forward section 72 angles upward from the balance of the deck platform 64 to increase the space within the hull for flotation elements 74, as noted above.

With reference to FIG. 1, a fuel tank 76 is located within the fore compartment 24 of the hull 12 beneath the hatch cover 28. Conventional means, such as, for example, straps, secure the fuel tank 76 to the lower hull 14. A fuel filler hose (not shown) extends between a fuel cap assembly and the fuel tank 76. In the illustrated embodiment, the filler cap assembly (not shown) is secured to the bow portion of the hull upper deck 16 to the side and in front of the control mast. In this manner, the fuel tank 76 can be filled with fuel F from outside the watercraft body 10 with the fuel F passing through the fuel filler hose into the tank 76.

A propulsion system 78 propels the watercraft 10. The propulsion system 78 comprises an engine 80 that drives a jet pump unit 82. The engine 80 is located in the engine compartment 50, while the jet pump unit 82 is mounted within the tunnel 20 formed on the underside of the hull 12 by a plurality of bolts.

As appreciated in FIG. 2, an intake duct of the jet pump unit 80 defines an inlet opening that opens into a gullet of the intake duct 81. The intake duct leads to an impeller housing assembly 84 in which the impeller 86 of the jet pump unit 80 operates. An impeller housing assembly 84 also acts as a pressurization chamber and delivers the water flow from the impeller housing to a discharge nozzle 88.

A steering nozzle 90 is supported at the downstream end of the discharge nozzle 88 by a pair of vertically extending pivot pins. In an exemplary embodiment, the steering nozzle has an integral lever on one side that is coupled to the handlebar assembly 30 through, for example, a bowden-wire actuator, as known in the art. In this manner, the operator of the watercraft 10 can move the steering nozzle 90 to effect directional changes of the watercraft 10.

As seen in FIG. 5, a ride plate 92 covers a portion of the tunnel 19 behind the inlet opening to enclose the jet pump unit 82 with the tunnel 20. In this manner, the lower opening of the tunnel 20 is closed to provide a planing surface for the watercraft 10.

An impeller shaft 94 (FIG. 2) supports the impeller 86 within the impeller housing 84 of the jet pump unit 82. The aft end of the impeller shaft 86 is suitably supported and journalled within the compression chamber of the jet pump unit 82 in a known manner. The impeller shaft 94 extends in the forward direction through a front wall of the tunnel 20 and through a bulkhead.

Figure 3:
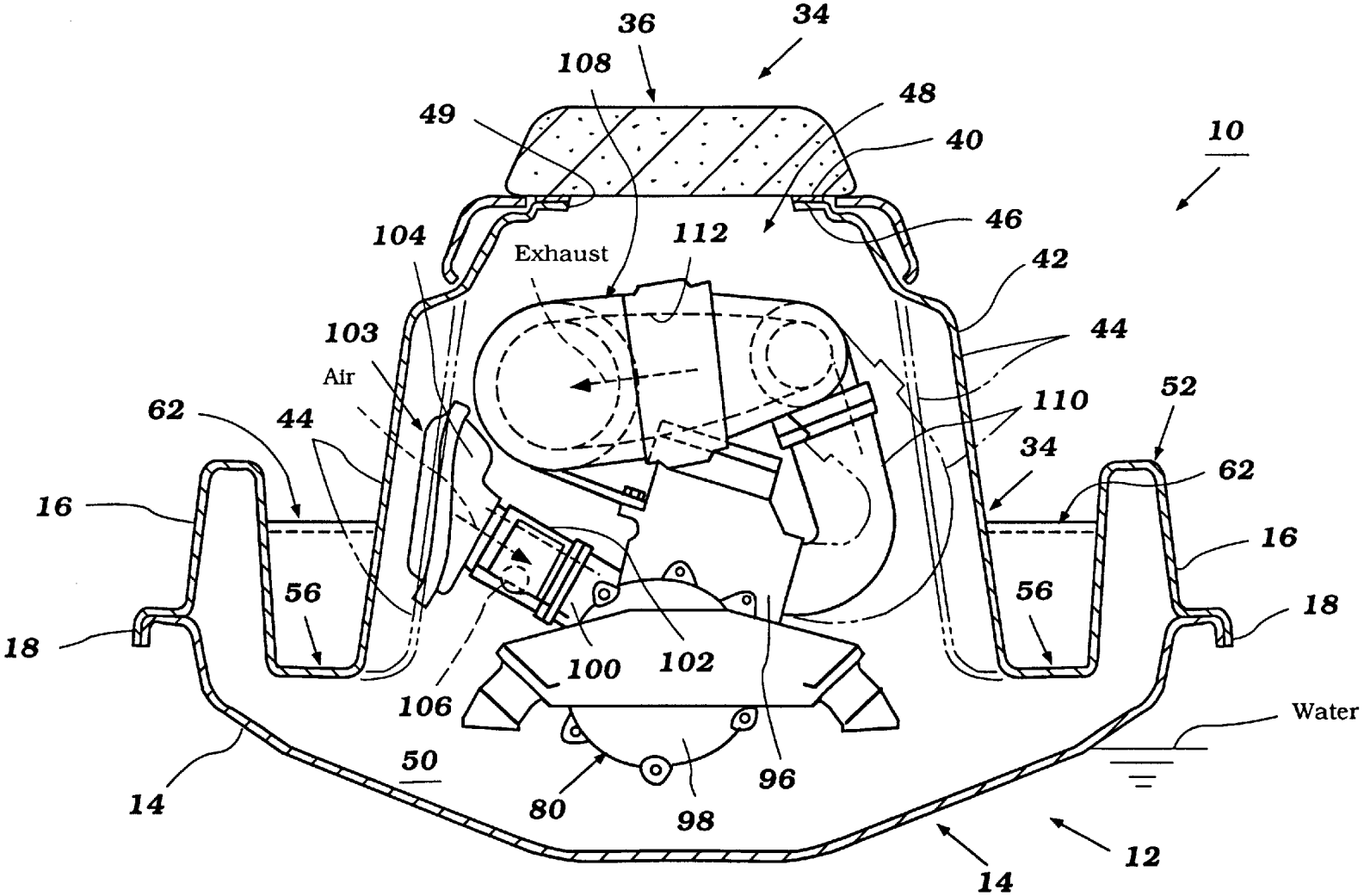
FIG. 3 is a cross-sectional view of the personal watercraft of FIG. 1 taken along line 3—3.

The internal combustion engine 80 of the watercraft 10 powers the impeller shaft 94 to drive the impeller 86 of the jet pump unit 82. As seen in FIGS. 1 through 3, the engine 80 is positioned within the engine compartment 50 and is mounted behind the control mast 24, beneath the seat assembly 34. Vibration-absorbing engine mounts (FIG. 3) secure the engine to bosses on the lower hull 14. The engine 80 is mounted in approximately a central position in the watercraft 10.

In the illustrated embodiment, the engine 80 includes three in-line cylinders and operates on a two-stroke, crankcase compression principle. The engine is positioned such that the row of cylinders lies parallel to a longitudinal axis of the watercraft 10, running from bow to stern. The axis of each cylinder is inclined relative to a vertical central plane of the watercraft 10, in which the longitudinal axis lies. This engine type, however, is merely exemplary. Those skilled in the art will readily appreciate that the present seat design and engine component layout can be used with a variety of engine types having other number of cylinders, having other cylinder arrangements (e.g., parallel to the vertical central plane) and operating on other combustion principles (e.g., four-stroke principle).

As best seen in FIG. 3, a cylinder block 96 and a cylinder head assembly desirably form the cylinders of the engine 80. A piston (not shown) reciprocates within each cylinder of the engine 80 and together the pistons drive an output shaft, such as a crankshaft, in a known manner. A connecting rod (not shown) links the corresponding piston to the crankshaft. The corresponding cylinder bore, piston and cylinder head of each cylinder forms a variable-volume chamber, which at a minimum volume defines a combustion chamber. A coupling couples the crankshaft to the impeller shaft 94, as best seen in FIG. 1.

The crankshaft desirably is journaled within a crankcase 98, which in the illustrated embodiment is formed between a crankcase member and a lower end of the cylinder block. Individual crankcase chambers of the engine are formed within the crankcase by dividing walls and sealing disks, and are sealed from one another with each crankcase chamber communicating with a dedicated variable-volume chamber.

Each crankcase chamber also communicates with an intake pipe 100 of an induction system of the engine through a check valve (e.g., a reed-type valve). In the illustrated embodiment, the intake pipes 100 are separate from the crankcase and from each other; however, the engine 80 can use an intake manifold equally well, or can integrally form the intake pipes with the crankcase member.

A plurality of charge formers 102 (e.g., a carburetor) of the induction system 103 communicate with inlet ends of the corresponding intake pipes 100. The charge formers 100 receive fuel from the fuel tank 76 and produce the fuel charge which is delivered to the cylinders in a known manner. An air intake silencer or plenum chamber 104 of the induction system is connected to an air inlet end of a throttle passage of each charge former 102. A throttle device 106 regulates air flow through the charge former 102, in a manner well known in the art.

An exhaust system 108 discharges exhaust byproducts from the engine 80 to the atmosphere and/or to the body of water in which the watercraft 10 is operated. As best seen in FIGS. 1, 2 and 4, the exhaust system includes the exhaust manifold 110 that is affixed to the side of the cylinder block 96 and which receives exhaust gases from the combustion chambers through exhaust ports in a well-known manner. For this purpose, the exhaust manifold 110 desirably includes a number of runners equal in number to the number of cylinders. Each runner communicates with the exhaust port(s) of the respective cylinder. The runners of the exhaust manifold 110 thence merge together at a merge point to form a common exhaust path that terminates at an outlet end of the manifold 110.

An outlet end of the exhaust manifold communicates with an exhaust expansion chamber 112. The outlet end of the manifold 110 turns upward to mate with a down-turned inlet end of the expansion chamber 112.

The expansion chamber 112 wraps around the front side of the engine and extends along an opposite side of the engine 80 to a point just beyond the rear side of the engine 80. The expansion chamber 112 then turns downward and communicates with a connection pipe 114.

The downstream end of the connection pipe 114 communicates with a water trap 116. The water trap 116 includes a generally cylindrical body that is coupled to the hull by suitable means. For example, one or more elastic straps, which are secured to the lower hull portion 14 by bolts, hold the water trap body to the hull.

The water trap device 116 has a sufficient volume to retain water and to preclude the back flow of water to the expansion chamber 112 and the engine 80. Internal baffles within the water trap device 116 help control water flow through the exhaust system 108.

An exhaust discharge pipe 118 extends from an outlet section of the water trap device 116 and wraps over the top of the tunnel 20 to a second water trap/expansion chamber 119. A second exhaust discharge pipe 121 extends from the second water trap 119 to a discharge end 120. The discharge end 120 either opens into the tunnel 20 or through the transom of the watercraft 10 at an area that is close to or actually below the water level with the watercraft 10 floating at rest on the body of water.

As schematically illustrated in FIG. 3, the larger width of the seat pedestal section above the engine 80 permits the header pipe 110 to extend through a larger radius of curvature than if the seat had a width equal to that of its aft end. Similarly, the induction system 103 can have a generally straight configuration with the intake silencer 104 positioned to the side of the engine. The performance of the engine 80 can be enhanced with the induction and exhaust systems 103, 108 configured so as to lessen restrictions within the flow paths defined by these systems.

Although this invention has been described in terms of a certain preferred embodiment, other embodiments apparent to those of ordinary skill in the art are also within the scope of this invention. It is also understood, that the above described features and aspects of the invention need not be practiced together. Accordingly, the scope of the invention is intended to be defined only by the claims that follow.

What is claimed is:

1. A watercraft comprising a body having a lower hull and an upper deck, the lower hull including a keel line, the deck including a pair of raised gunnels that extend along at least a portion of a length of the watercraft body, foot areas positioned inside the raised gunnels, and a deck platform positioned behind the foot areas, each foot area being formed in part by a floor that extends to and smoothly transitions with the deck platform, the floor having a raised aft section that rises above the level of the deck platform relative to the keel line, the gunnels, foot area floors and deck platform of the deck having a unitary construction.

2. A watercraft as in claim 1, wherein the upper deck includes a longitudinally extending seat that includes at least a fore rider position and an aft rider position, and the raised aft section extends in a longitudinal direction, which is generally parallel to the keel line, from a point forward of an aft end of the seat aft rider position to a point rearward of the aft end of the seat aft rider position.

3. A watercraft as in claim 2, wherein the raised aft section of the foot area floor includes a downwardly sloped surface which is positioned longitudinally so as to coincide generally with a position at a fore side of the seat aft rider position.

4. A watercraft as in claim 2 additionally comprising an internal combustion engine located in an engine compartment formed between the upper deck and the lower hull at a location below the seat, and the seat is wider at the location above the engine than at the seat aft rider position.

5. A watercraft as in claim 1, wherein each floor includes a fore section that is arranged lower than the deck platform.

6. A watercraft as in claim 1, wherein the raised aft section has a hump-like shape.

7. A watercraft as in claim 6, wherein the raised aft section generally has an arcuate shape.

8. A watercraft as in claim 1 additionally comprising an internal combustion engine located within the hull and having an output shaft, and a propulsion device carried by the hull and driven by the engine output shaft to propel the watercraft, the propulsion device including at least one water intake duct, and the raised aft sections of the foot area floors positioned longitudinally so as to coincide generally with a position at the water intake duct.

9. A watercraft as in claim 1 additionally comprising first and second members extending toward a stern of the watercraft and being arranged contiguous to the deck platform, each of the first and second members having a length so dimensioned to be grasped by a hand of a rider when entering the watercraft from a body of water in which the watercraft is operated.

10. A watercraft comprising a body having a lower hull and an upper deck, the lower hull including a keel line, the deck including a pair of raised gunnels that extend along at least a portion of a length of the watercraft body, a longitudinally extending seat that includes at least a front rider position and an aft rider position arranged rearward of the front rider position on the seat, the seat being positioned between the raised gunnels, foot areas arranged between the raised gunnels and the seat, and a deck platform positioned behind the foot areas, each foot area being formed in part by a floor that extends to the deck platform, the floor having a raised aft section that rises above the level of the deck platform relative to the keel line and has a generally curvilinear shape, the raised aft section extending in a longitudinal direction, which is generally parallel to the keel line, from a point forward of an aft end of the seat aft rider position to a point rearward of the aft end of the seat aft rider position.

11. A watercraft as in claim 10, wherein the raised aft section of each foot area floor includes a downwardly sloped surface which is positioned longitudinally so as to coincide generally with a position at a fore side of the seat aft rider position.

12. A watercraft as in claim 10 additionally comprising an internal combustion engine located in an engine compartment formed between the upper deck and the lower hull at a location below the seat, and the seat is wider at the location above the engine than at the seat aft rider position.

13. A watercraft as in claim 10, wherein each floor includes a fore section that is arranged lower than the deck platform.

14. A watercraft as in claim 10, wherein each raised aft section generally has an arcuate shape.

15. A watercraft as in claim 10 additionally comprising first and second members extending toward a stern of the watercraft and being arranged contiguous to the deck platform, each of the first and second members having a length so dimensioned to be grasped by a hand of a rider when entering the watercraft from a body of water in which the watercraft is operated.

16. A watercraft as in claim 10 additionally comprising an internal combustion engine located within the hull and having an output shaft, and a propulsion device carried by the hull and driven by the engine output shaft to propel the watercraft, the propulsion device including at least one water intake duct, and the raised aft sections of the foot area floors positioned longitudinally so as to coincide generally with a position at the water intake duct.

17. A watercraft having a body comprised of a lower hull and an upper deck, the upper deck including a longitudinally extending seat positioned between a pair of raised gunnels and being supported by a seat pedestal, a deck platform arranged behind the seat, and first and second members extending toward a stern of the watercraft and being arranged contiguous to the deck platform, each of the first and second members rigidly extending from the seat pedestal and having a length so dimensioned to be grasped by a hand of a rider when entering the watercraft from a body of water in which the watercraft is operated.

18. A watercraft as in claim 17, wherein a spacing between aft ends of the first and second members is generally less than a width of the seat.

19. A watercraft as in claim 17, wherein the first and second members include rounded upper edges.

20. A watercraft as in claim 17, wherein at least a portion of the deck platform extends between the first and second members.

21. A watercraft as in claim 17, wherein the seat includes a pedestal, and the first and second members extend rearward from the pedestal.

22. A watercraft as in claim 17, wherein each of the first and second members includes an upper edge that extends above the deck platform.

23. A watercraft as in claim 17, wherein the first and second members are formed unitarily with the seat pedestal.

24. A watercraft having a body comprised of a lower hull and an upper deck, the upper deck including a longitudinally extending seat positioned between a pair of raised gunnels, a deck platform arranged behind the seat the first and second members extending toward a stern of the watercraft and being arranged contiguous to the deck platform, each of the first and second members having a length so dimensioned to be grasped by a hand of a rider when entering the watercraft from a body of water in which the watercraft is operated, and an internal combustion engine located in an engine compartment formed between the upper deck and the lower hull at a location below the seat, the seat being wider at the location above the engine than at the seat aft rider position.

25. A watercraft as in claim 24, wherein each of the first and second members include an upper edge which extends above the deck platform.

26. A watercraft as in claim 24, wherein a spacing between aft ends of the first and second members is generally less than a width of the seat.

27. A watercraft as in claim 24, wherein the seat includes a pedestal, and the first and second members extend rearward from the pedestal.

28. A watercraft having a body comprised of a lower hull and an upper deck, the upper deck including a longitudinally extending seat positioned between a pair of raised gunnels, a deck platform arranged behind the seat, and first and second members extending toward a stern of the watercraft and being arranged contiguous to the deck platform each of the first and second members having a length so dimensioned to be grasped by a hand of a rider when entering a watercraft from a body of water in which the watercraft is operated, at least a portion of the deck platform extending between the first and second members, wherein the portion of the deck platform that extends between the first and second members rises above an aft section of the deck platform.

29. A watercraft as in claim 28 additionally comprising a pair of foot areas that extend along side the seat, each foot area including a raised aft floor section having a generally curvilinear shape and rising above the deck platform.

30. A watercraft as in claim 28, wherein each of the first and second members includes an upper edge which extends above the deck platform.

31. A watercraft as in claim 28, wherein a spacing between aft ends of the first and second members is generally less than a width of the seat.

32. A watercraft as in claim 28, wherein the seat includes a pedestal, and the first and second members extend rearward from the pedestal.

33. A watercraft having a body comprised of a lower hull and an upper deck the upper deck including a longitudinally extending seat positioned between a pair of raised gunnels, a deck platform arranged behind the seat, the seat including a pedestal, and first and second members extending toward a stern of the watercraft and being arranged contiguous to the deck platform each of the first and second members having a length so dimensioned to be grasped by a hand of a rider when entering the watercraft from a body of water in which the watercraft is operated wherein the first and second members are unitarily formed with the seat pedestal.

34. A watercraft according to claim 33, wherein each of the first and second members include an upper edge that extends above the deck platform.

35. A watercraft according to claim 33, wherein a spacing between aft ends of the first and second members is generally less than a width of the seat.

36. A watercraft according to claim 33, wherein the seat includes a pedestal, and the first and second members extend rearward from the pedestal.

* * * * *